US009861542B2

(12) United States Patent
Christian

(10) Patent No.: US 9,861,542 B2
(45) Date of Patent: Jan. 9, 2018

(54) LIFT-ASSIST CHAIR

(71) Applicant: Senior Life LLC, Hermitage, TN (US)

(72) Inventor: Curt Christian, Hermitage, TN (US)

(73) Assignee: Senior Life LLC, Hermitage, TN (US)

( * ) Notice: Subject to any disclaimer, the term of this patent is extended or adjusted under 35 U.S.C. 154(b) by 0 days.

(21) Appl. No.: 15/187,696

(22) Filed: Jun. 20, 2016

(65) Prior Publication Data

US 2016/0374879 A1 Dec. 29, 2016

Related U.S. Application Data

(60) Provisional application No. 62/182,378, filed on Jun. 19, 2015.

(51) Int. Cl.

| | |
|---|---|
| ***A47C 1/00*** | (2006.01) |
| ***A61G 5/14*** | (2006.01) |
| ***A47C 7/00*** | (2006.01) |
| ***A47C 3/18*** | (2006.01) |
| ***A47C 1/029*** | (2006.01) |
| ***A47C 3/025*** | (2006.01) |

(Continued)

(52) U.S. Cl.

CPC ..... *A61G 5/14* (2013.01); *A47C 1/029* (2013.01); *A47C 3/0252* (2013.01); *A47C 3/18* (2013.01); *A47C 7/006* (2013.01); *A61G 5/1072* (2013.01); *A61G 5/125* (2016.11)

(58) Field of Classification Search

CPC ..... A61G 5/14; A61G 5/1072; A61G 5/125; A47C 7/006; A47C 3/18; A47C 3/0252; A47C 1/029

USPC ..... 297/DIG. 10

See application file for complete search history.

(56) References Cited

U.S. PATENT DOCUMENTS

| | | | |
|---|---|---|---|
| 3,039,818 | A | 6/1962 | Frank |
| 3,158,398 | A | 11/1964 | Stryker |
| 3,259,427 | A | 7/1966 | Weist |

(Continued)

FOREIGN PATENT DOCUMENTS

| | | | | |
|---|---|---|---|---|
| EP | 2808001 | A1 | 12/2014 | |
| GB | 2183150 | A * | 6/1987 | ..... A61G 5/14 |
| WO | 2010120225 | A1 | 10/2010 | |

OTHER PUBLICATIONS

International Search Report dated Sep. 8, 2016 in corresponding PCT patent application PCT/US2016/038438.

(Continued)

*Primary Examiner* — Rodney B White

(74) *Attorney, Agent, or Firm* — Waller Lansden Dortch & Davis, LLP; Mark A. Pitchford; Blake M. Bernard

(57) ABSTRACT

A lift-assist chair is provided. The presently-disclosed lift-assist chairs can comprise a seat frame, a seat base that is pivotally coupled to the front edge of the seat frame and can be moved between a depressed position and an extended position, an arm support having a proximate end that is coupled to a lateral edge of the seat frame and a distal end that extends from the top side of the seat frame, an arm that is pivotally coupled to the arm support about a point located between a front end and a rear end of the arm, and an arm connector coupling the arm to the seat base and disposed towards the rear end of the first arm relative to the first arm support. Movement of the seat base between a depressed position and an extended position can assist an individual when sitting or standing from the chair.

19 Claims, 10 Drawing Sheets

(51) Int. Cl.
*A61G 5/10* (2006.01)
*A61G 5/12* (2006.01)

(56) References Cited

U.S. PATENT DOCUMENTS 4,598,944 A 7/1986 Meyer et al.
4,778,217 A 10/1988 Lane
4,838,612 A * 6/1989 Cross ..... A61G 5/14 297/DIG. 10X
4,907,303 A 3/1990 Baird
4,929,022 A 5/1990 Geraci
4,979,726 A * 12/1990 Geraci ..... A61G 5/14 297/DIG. 10X
5,054,852 A 10/1991 Tholkes
5,116,100 A 5/1992 Iversen
5,161,812 A 11/1992 DeWeese
5,203,610 A 4/1993 Miller
5,375,911 A 12/1994 Morrow
5,624,159 A * 4/1997 Celoni ..... A47C 1/0246 297/DIG. 10X
5,651,580 A * 7/1997 LaPointe ..... A47C 1/0355 297/DIG. 10X
6,161,229 A * 12/2000 Ryan ..... A61G 5/14 297/DIG. 10
6,352,138 B1 3/2002 Duran et al.
6,398,305 B1 * 6/2002 Ball ..... A47C 1/0244 297/DIG. 10X
6,454,285 B1 9/2002 Koenig
6,637,818 B2 * 10/2003 Williams ..... A61G 5/14 297/DIG. 10X
6,702,383 B2 * 3/2004 Newman ..... A61G 5/14 297/DIG. 10X
6,779,848 B1 * 8/2004 Sanders ..... A61G 5/1059 297/DIG. 10X
6,783,179 B2 * 8/2004 Komura ..... A61G 5/14 297/DIG. 10X
6,945,604 B2 * 9/2005 Splane, Jr. ..... A61G 5/14 297/DIG. 10X
7,021,713 B2 * 4/2006 Kao ..... A61G 5/14 297/DIG. 10X
7,434,882 B1 * 10/2008 Hodges ..... A61G 5/14 297/DIG. 10X
8,360,518 B2 1/2013 Braaten
8,398,171 B2 * 3/2013 Lin ..... A61G 5/14 297/DIG. 10X
8,740,304 B2 * 6/2014 Yu ..... A61G 5/14 297/DIG. 10X
8,876,138 B2 11/2014 Wilde
2011/0248530 A1 10/2011 Sartisohn

OTHER PUBLICATIONS

Written Opinion dated Sep. 8, 2016 in corresponding PCT patent application PCT/US2016/038438.

* cited by examiner

LIFT-ASSIST CHAIR

RELATED APPLICATIONS

This application claims priority from U.S. Provisional Patent Application No. 62/182,378, filed Jun. 19, 2015, the entire disclosure of which is incorporated herein by this reference.

TECHNICAL FIELD

The presently-disclosed subject matter generally relates a chair. In particular, embodiments of the presently-disclosed subject matter relate to a chair that can assist an individual sitting and/or standing from the chair.

INTRODUCTION

Chairs are used worldwide so that people can comfortably remain in a seated position when working, eating, socializing, or the like. Chairs are typically comprised of a plurality of legs that extend from a bottom side of a seat base. Chair legs generally extend down and out from the seat base, and the distal ends of the legs all define points on a plane so that the legs support a chair when it is placed on a floor surface. Chairs can also include a back rest that extends from a rear side of the seat base that can support an individual in an upright, seated position.

The seat base of a chair is typically placed at a height that will be comfortable in a seated position. For instance, a seat base may be positioned so that an individual can sit at the edge of a table when working or eating. A seat base may also be positioned so that the feet of an individual in the seated position are in contact or close proximity to a floor surface. While the height of the seat base is not particularly limited, and may vary depending on the intended use of a chair, an individual must usually squat down and lower themselves into a seated position on a chair. Conversely, when standing from a chair, an individual must use physical force to lift themselves up from a seated position and off of the chair.

Sitting or standing from a seated position on a chair can be can be difficult or impossible for certain people. For example, the elderly, disabled, injured, or other individuals may find it difficult or impossible to controllably lower themselves into a seated position on a chair. Similarly, certain individuals may lack the strength or flexibility to stand from a seated position on a chair. Difficulties in sitting or standing from chairs can impact the safety and well-being of such individuals. For instance, individuals may injure themselves attempting to sit or stand from a chair when they lack the physical strength or flexibility to do so.

Such individuals may compensate by using arm strength to sit or stand from a chair. Individuals can brace themselves on the arms or other portion of a chair and use their arm strength to help control the rate at which they lower themselves onto the chair. Individuals may also push off of a chair with their arms to provide assistance when standing from a seated position. However, in doing so, an individual may inadvertently cause the chair to slide out from under the individual. This can cause an individual to incur addition strain or to fall. Such falls can result in serious injury, particularly if the individual is suffering from osteoporosis or other diseases or conditions. Serious injury can also occur if the individual hits their head in a fall. For this reason, accidental falls from chairs account for a substantial proportion of injuries in nursing homes, assisted living facilities, and the like.

Furthermore, some individuals lack the strength required to sit or stand from a chair even when they utilize their arm strength to brace themselves. Such individuals are unable to sit or stand without personal assistance. Accordingly, such individuals have reduced mobility, which can lead to other ailments, and may also become depressed or feel hopeless because their mobility and comfort is dependent on the assistance of others.

Accordingly, there remains a need for a chair that can assist an individual when sitting and/or standing from the chair. There also remains a need for mechanisms that can reduce or eliminate the extent to which chairs, including rolling chairs, unintentionally slide when an individual attempts to sit or stand from the chair.

SUMMARY

Embodiments of the presently-disclosed subject matter meet some or all of the above-identified needs. This Summary describes several embodiments of the presently-disclosed subject matter, and in many cases lists variations and permutations of these embodiments. Such embodiments can typically exist with or without the feature(s) mentioned; likewise, those features can be applied to other embodiments of the presently-disclosed subject matter, whether listed in this Summary or not. To avoid excessive repetition, this Summary does not list or suggest all possible combinations of such features, which will become evident to those of ordinary skill in the art after a study of the information provided in this document.

The presently-disclosed subject matter includes a lift-assist chair. Embodiments of a chair can comprise the following:

a seat frame having a front edge, a rear edge, a first lateral edge, a second lateral edge, a bottom side, and a top side;

a seat base disposed on the top side of the seat frame that is pivotally coupled to the front edge of the seat frame, the seat base being moveable with respect to the seat frame between a depressed position and an extended position;

a first arm support having a proximate end that is coupled to the first lateral edge of the seat frame and a distal end that extends from the top side of the seat frame;

a first arm having a front end and a rear end, the first arm being pivotally coupled to the first arm support about a point located between the front end and the rear end of the first arm; and a first arm connector having one end coupled to the first arm and another end coupled to the seat base, the first arm connector being disposed towards the rear end of the first arm relative to the first arm support.

In some instances a chair can further comprise the following:

a second arm support having a proximate end that is coupled to the second lateral edge of the seat frame and a distal end that extends from the top side of the seat frame;

a second arm having a front end and a rear end, the second arm being pivotally coupled to the second arm support about a point located between the front end and the rear end of the second arm; and a second arm connector having one end coupled to the second arm and another end coupled to the seat base, the second arm connector being disposed towards the rear end of the second arm relative to the second arm support.

In some instances, a chair can include a plurality of legs that extend from a bottom side of a seat frame. In some instances, a chair comprises casters, and in some instances casters are provided on distal ends of two of the legs of a chair. In some instances casters are partially recessed within the distal ends of the legs of a chair.

In some instances, a chair further comprises a back frame coupled to a rear edge of a seat frame and extending from a top side of a seat frame. In some instances, a chair further comprises a seat stop disposed on a top side of a seat frame, the seat stop being disposed toward a rear edge of the seat frame relative to a first arm support. In some instances, a chair further comprises a spring disposed on a top side of a seat frame, the spring being configured to exert force on a seat base to move a seat base relative to the seat frame.

In some instances, a chair can further comprise a base having a top side and a bottom side, the base being disposed on a bottom side of a seat frame, and a swivel mounted to a top side of the base and coupled to the seat frame. In such instances, a chair can further comprise a slot extending through the base and having a shape of an arc, a plurality of holes that each extend through the base and are arranged in the shape of an arc that is substantially parallel to the slot, and a hook having a base end and a tip end and that is slideably received through the slot, the base end being coupled to a bottom side of the seat base and the tip end being configured to engage one of the plurality of holes when the seat base is in the extended position. In some instances the slot defines an arc having a measure of about 90 degrees to about 270 degrees.

In some instances, a chair can further comprise a spring disposed on the top side of a seat frame, the spring being configured to exert force on a seat base to pivot the seat base relative to the seat frame. In yet other embodiments of a chair, a seat base in a depressed position is substantially parallel to a seat frame, and the seat base in an extended position is angled by about 5 degrees to about 60 degrees relative to the seat frame.

The presently-disclosed subject matter also includes embodiments of a lift-assist chair that comprise the following:

a seat frame having a front edge, a rear edge, a two lateral edges, a bottom side, and a top side;

a seat base disposed on the top side of the seat frame that is pivotally coupled to the front edge of the seat frame, the seat base being moveable with respect to the seat frame between a depressed position and an extended position;

a pair of arm supports each extending from one of the lateral edges of the seat frame;

a pair of arms each having a front end and rear end, each of the arms being pivotally coupled to one of the arm supports at a point located between of the front end and the rear end of each of the arms;

a pair of arm connectors that each couple one of the arms to the seat base; and at least one leg extending from the bottom side of the seat frame.

In some instances a chair can further comprise a base having a top side and a bottom side, the base being disposed on a bottom side of the seat frame, and a swivel mounted to the top side of the base and coupled to the seat frame. In such instances, a chair can further comprise a slot extending through the base and having a shape of an arc, a plurality of holes that each extend through the base and are arranged in the shape of an arc that is substantially parallel to the slot, and a hook that is slideably received through the slot and having a base end and a tip end, the base end being coupled to a bottom side of the seat base, and the tip end being configured to engage one of the plurality of holes when the seat base is in the extended position. In yet further instances, a chair can further comprise a spring that exerts a force between the seat frame and seat base.

The presently-disclosed subject matter further includes embodiments of a lift-assist chair that comprise the following:

a seat frame;

a seat base disposed on the top side of the seat frame that can be moved with respect to the seat frame between a depressed position and an extended position;

an arm support that extends upwardly from the seat frame;

an arm that is pivotally coupled to the arm support; and an arm connector that couples the arm to the seat base, the arm connector being configured to move the seat base between the depressed position and the extended position when the arm is pivoted with respect to the arm support.

In some instances a chair can further comprise the following:

a base having a top side and a bottom side, the base being disposed on a bottom side of the seat frame;

a slot extending through the base and having a shape of an arc;

a plurality of holes that each extend through the base and are arranged in the shape of an arc that is substantially parallel to the slot;

a hook that is slideably received through the slot and having a base end and a tip end, the base end being coupled to a bottom side of the seat base, and the tip end being configured to engage one of the plurality of holes when the seat base is in the extended position; and a swivel mounted to the top side of the base and coupled to the seat frame.

In some instances, a chair can further comprise a spring disposed between the seat frame and seat base configured to move the seat base between a depressed position and an extended position.

DETAILED DESCRIPTION OF EXEMPLARY EMBODIMENTS

The details of one or more embodiments of the presently-disclosed subject matter are set forth in this document. Modifications to the exemplary embodiments described in this document, and other embodiments, will be evident to those of ordinary skill in the art after a study of the information provided in this document. The information provided in this document, and particularly the specific details of the described exemplary embodiments, is provided primarily for clearness of understanding and no unnecessary limitations are to be understood therefrom. In case of conflict, the specification of this document, including definitions, will control.

Figure 1:
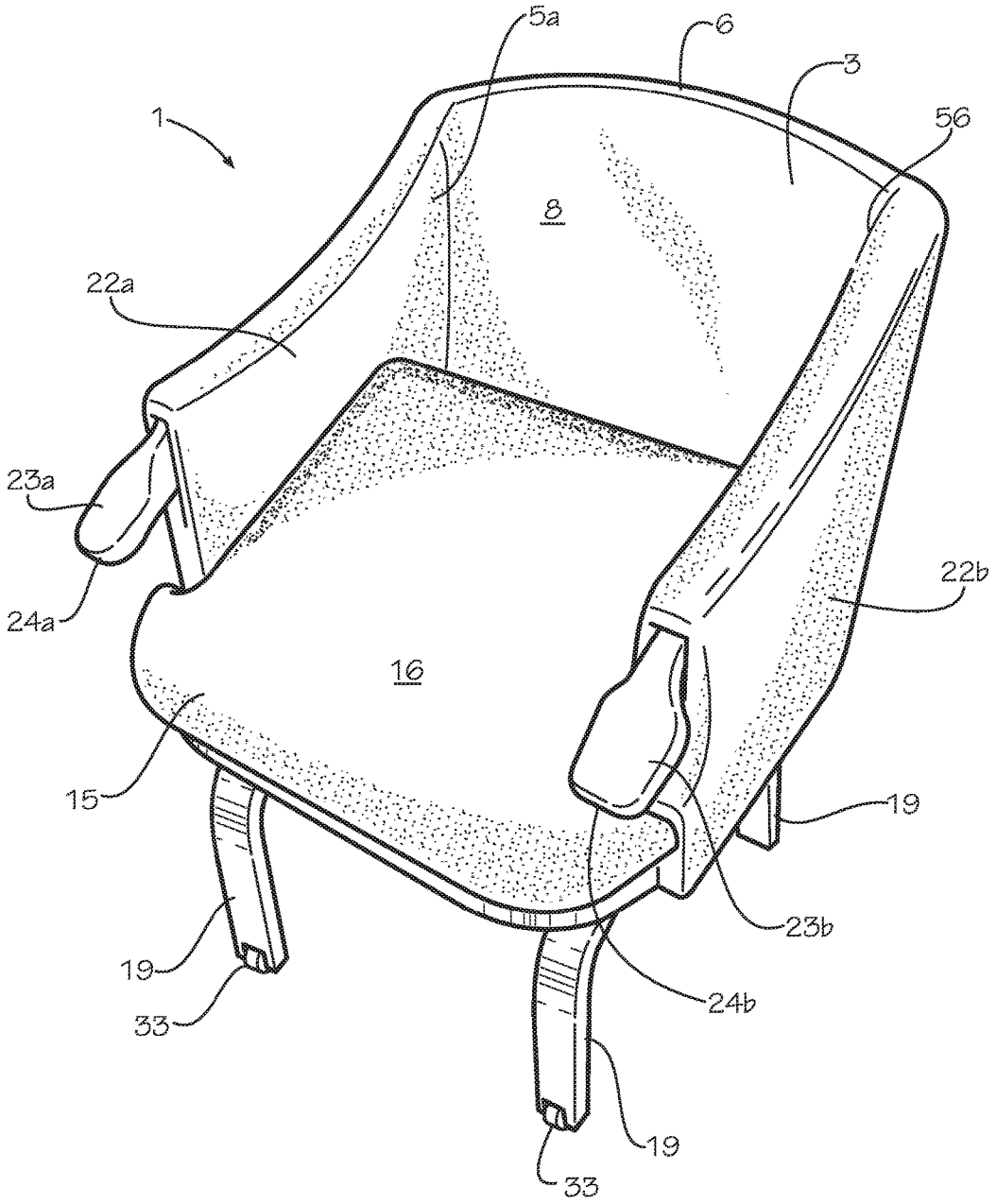
FIG. 1 shows a perspective view of a lift-assist chair in accordance with an embodiment of the presently-disclosed subject matter.

As described herein, the upright position of the chair 1 shown in FIG. 1 is considered to be the position of apparatus components while in proper operation as described herein. Vertical, horizontal, front, rear, top, bottom, and other orientation terms are described with respect to the chair shown in FIG. 1 unless otherwise specified. Likewise, front refers to a side closest to the viewer in FIG. 1, rear refers to a side facing away from a viewer from the perspective shown in FIG. 1, and lateral sides refer to left and right sides of the chair 1 and its components as shown in FIG. 1.

The presently-disclosed subject matter includes a chair that can provide lift-assistance and is referred to as a lift-assist chair herein. The presently-disclosed chairs are configured such that an individual can have additional assistance when sitting into a chair relative to conventional chairs. Embodiments of the presently-disclosed chairs can also be configured such that an individual can have additional assistance when standing from a chair relative to conventional chairs. In some embodiments, the presently-disclosed chairs are configured such that an individual is assisted when sitting into the chair as well as when standing from a chair. Accordingly, the presently-disclosed lift-assist chairs can aid elderly, disabled, injured, sick, and other individuals when sitting and/or standing. Such individuals may otherwise have difficulty or be unable to lower themselves into a seated position or raise themselves from a seated position.

Looking now to FIG. 1, a perspective view of an embodiment of a lift-assist chair 1 is shown. The chair 1 can resemble a traditional chair 1 in its assembled state. The chair 1 includes a seat base 15. The seat base 15 includes an internal frame that supports a cushioning material such that the seat base 15 is integral with a seat cushion 16. In some embodiments the seat base 15 is comprised of one or more materials that have cushioning properties. In other embodiments the seat base is a rigid frame or continuous material, and a seat cushion is provided as a separate component on a top side of a seat base. The seat cushion can be connected to the seat base by any suitable mechanical or chemical adhesive, including nails, screws, staples, tape, glue, or the like. Thus, the term seat base as used herein refers to seat bases that may or may not comprise a seat cushion, wherein the seat cushion can be defined by the seat base, a separate component that is supported and/or provided on the seat base, or integral with the seat base.

The chair 1 also includes a back frame 3 that extends upwardly from a rear edge of the seat base 15. The back frame 3 includes a first lateral edge 5*a*, a second lateral edge 5*b*, a top edge 6, and a bottom edge 7. The back frame 3 includes a handle 4 that is defined by an opening extending through the back frame 3. The back frame 3 includes an internal frame that supports a cushioning material such that the seat base 15 is integral with a back cushion 8. In some embodiments the back frame is comprised of one or more materials that have cushioning properties. In other embodiments the back frame is a rigid frame or continuous material, and a back cushion is provided as a separate component on a surface of a back frame. The back cushion can be connected to the back frame by any suitable mechanical or chemical adhesive, including nails, screws, staples, tape, glue, or the like. Thus, the term back frame as used herein refers to back frames that may or may not comprise a back cushion, wherein the back cushion can be defined by the seat base, a separate component that is supported and/or provided on the seat base, or integral with the seat base.

The chair also includes four legs 19 that extend from a bottom side 14 of the seat frame 9. A leg may refer to any structure that can support a chair and the weight of an individual sitting on the chair. In some embodiments a leg is comprised of a single component that supports a chair at a desired height. In other embodiments a chair can include three or more legs configured to support a chair. Legs that extend from a bottom side of a seat frame include legs that are coupled indirectly or directly to a bottom side of a seat frame as well as legs that are coupled to other portions of a chair and that extend downwardly relative to a bottom side of the seat frame.

In this regard, the term "couple" is used interchangeably herein with the terms "connect," "mount," "attach," and the like to refer to a connection between distinct components, including both permanent and non-permanent connections between components as well as both direct and indirect connections between components. For instance, two components may be coupled together by welds, bolts, screws, adhesives, or the like. In some instances components that are not mechanically or chemically adhered together may be referred to as being coupled together if they are arranged such that movement of one component directly translates into movement of the other component.

The chair further comprises side panels 22*a*, 22*b* provided on the lateral sides of the chair. A portion of each of the first arm 23*a* and the second arm 23*b* extend from openings provided in the side panels 22. In some embodiments side panels provide a covering for the mechanical components of a chair. Thus, embodiments of coverings of different shapes and sizes can be provided depending on the intended use of a chair.

Figure 2:
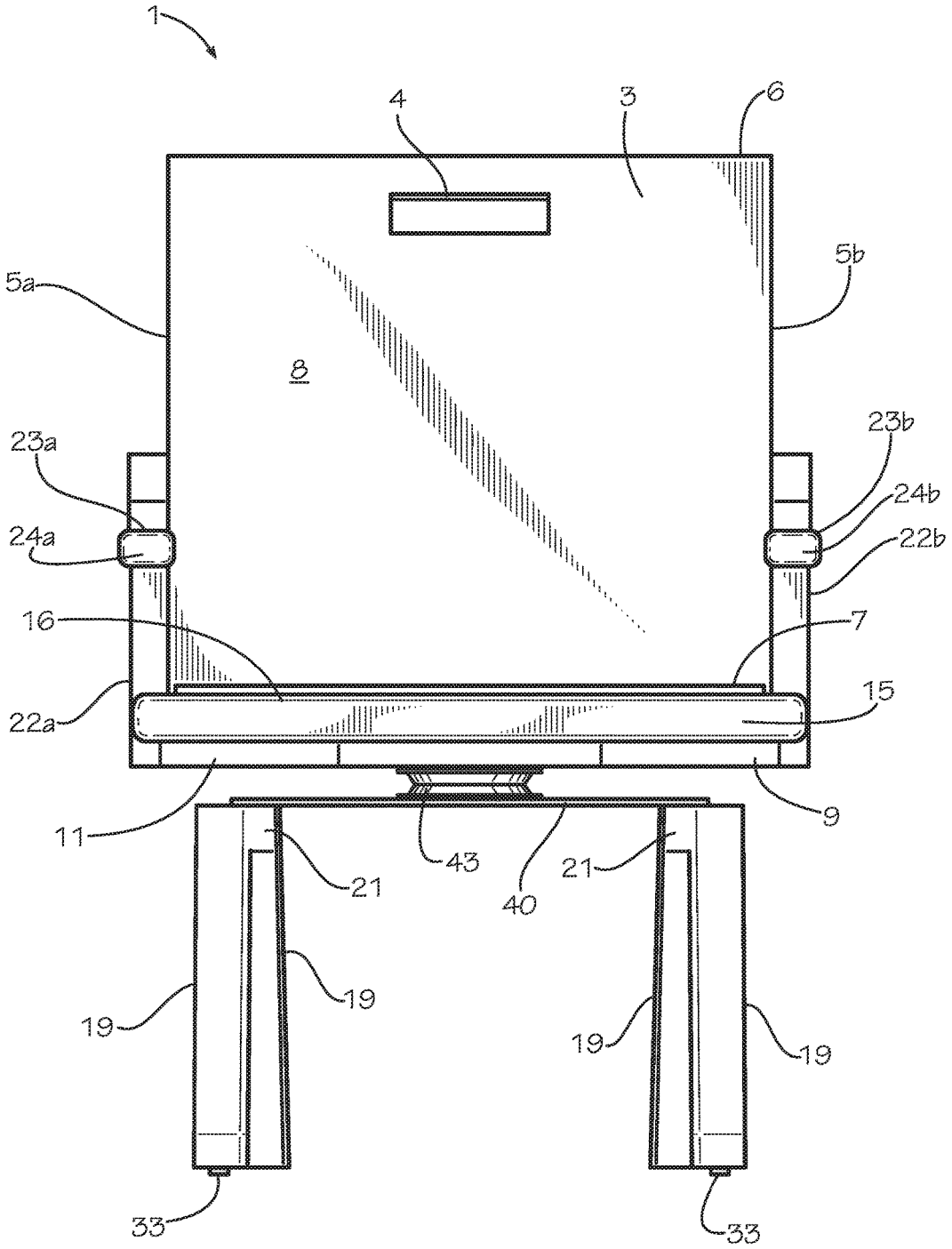
FIG. 2 shows a front view of the embodied chair.
Figure 3:
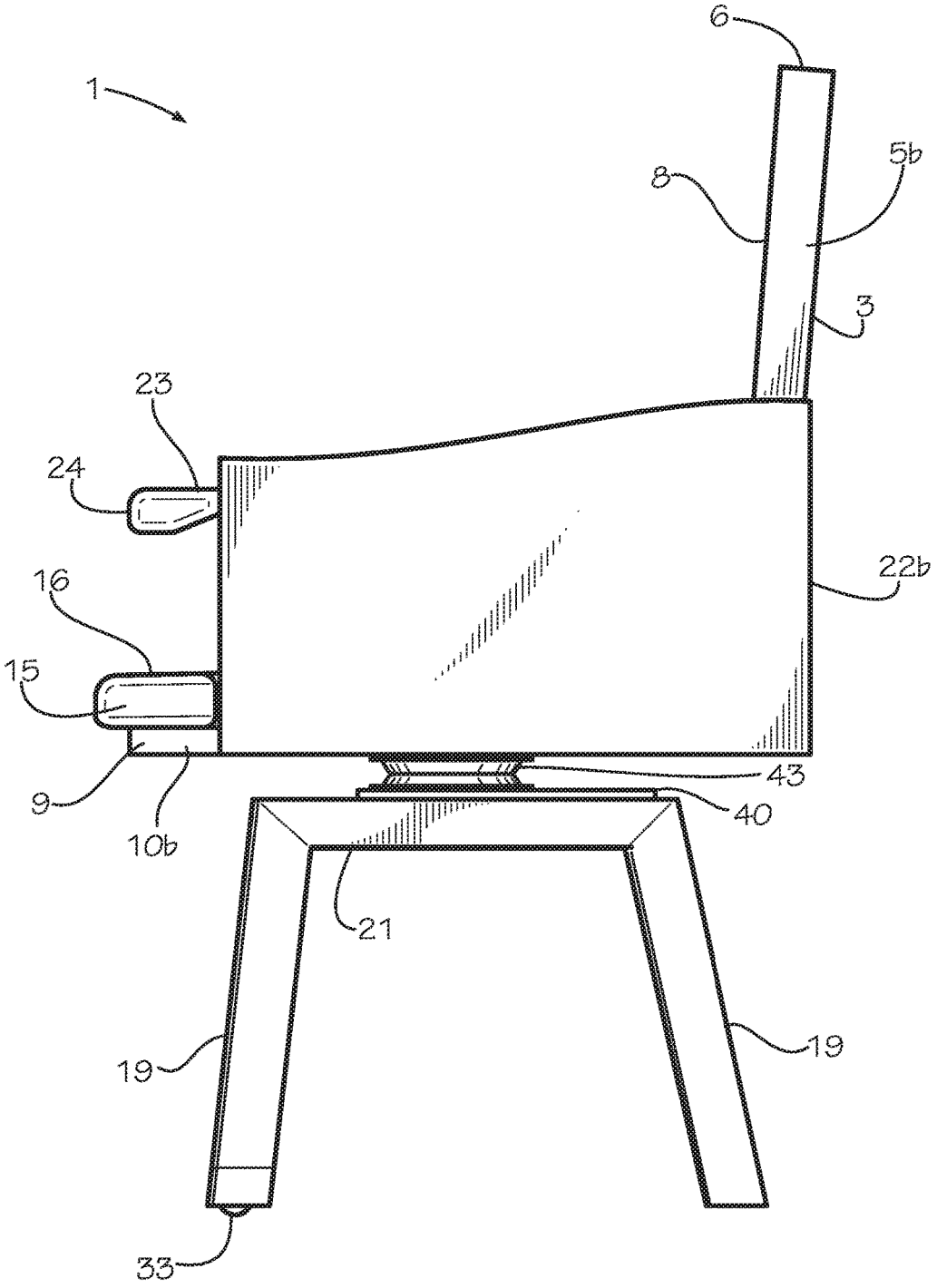
FIG. 3 shows a side view of the embodied chair.

Looking now to FIGS. 2 and 3, front and side views of the chair are shown. The legs 19 of chair 1 include leg supports 21 provided at the top end of the legs 19. The leg supports 21 connect adjacent pairs of legs 19 and are configured to provide additional structural rigidity to the legs 19 of the chair 1.

In other embodiments any number and a variety of different shapes, sizes, and configurations of leg supports may be provided at any location along the legs in order to enhance the chair aesthetically, structurally, or both. For instance, leg supports may offer additional structural support to the chair by minimizing stress at junctions between the legs and the seat frame or between the legs and a base. Thus, in some instances leg supports can increase the horizontal forces that a chair can bear. In other embodiments a chair includes legs that do not include leg supports.

In the embodied chair 1, each pair of legs 19 extend from one leg support 21, and each pair of legs 19 form a substantially U-shaped structure with the corresponding leg support 21. The two pairs of legs 19 and leg supports 21 are placed side-by-side, and top sides of the legs supports 21 are mounted to a bottom side 42 of a base 40 in order to connect the four legs 19 to form a single structure. A swivel 43 is disposed between and connects the top side 41 of the base 40 and a bottom side 14 of the seat frame 9 so that the chair can spin about an axis that is defined by the swivel 43. In the embodied chair the base 40 is comprised of a flat plate. In other embodiments the base is integral with the top of the legs or any other structure that supports the chair.

Casters 33 are provided at distal ends of the two forwardly disposed legs 19. The casters 33 are partially recessed within the distal ends of the legs 19 such that only a portion of the casters 33 are visible when the chair is placed on a floor surface. An individual may move a chair by lifting the rear end of the chair 1 with the handle 4 or otherwise tilting the chair 1 so that it can roll along a floor surface on the casters 33. The term "caster" is used herein to refer to any component capable of being rolled on a floor surface to move a chair, and is inclusive of wheels, rollers, or the like. In other embodiments, a chair can include one caster or more than two casters, and casters may be provided on some or all of the legs. In other embodiments, casters are not recessed at distal ends of the legs.

Figure 9:
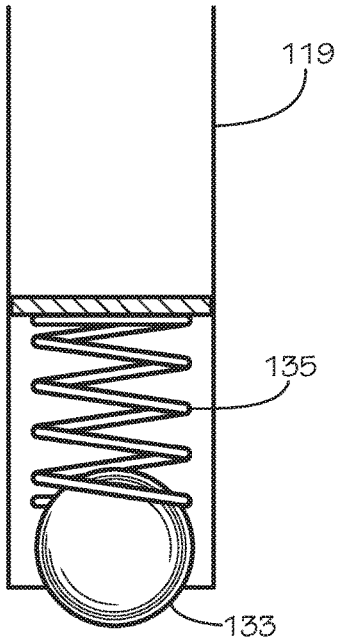
FIG. 9 shows an embodiment of a caster on a chair in accordance with another embodiment of the presently-disclosed subject matter.

In yet further embodiments, chairs are configured to minimize slippage of the chair when sitting or standing from the chair. For instance, FIG. 9 shows a cross-sectional view of the distal end of a leg 119. The leg 119 includes a recess at its distal end. A spring 135 is be disposed within the recess such that the compression axis of the spring 135 is parallel with a longitudinal axis of the leg 119. A caster 133 comprised of a metal ball is provided on an end of the spring 135. The spring 135 is configured such that the spring 135 is compressed when weight is applied to the leg 119, thereby causing the caster 133 to retract into the recess provided at the distal end of the 119. The distal end of the leg 119 contacts a floor surface in this retracted configuration. When weight is removed from the leg 119, the spring 135 expands such that at least a portion of the caster 133 protrudes from the distal end of the leg 119 and can contact a floor surface.

Accordingly, the chair can be moved by rolling the chair on the exposed caster(s) 133. On the other hand, as downward force is applied to the chair and the springs 135 compress to retract the caster 133 into the recess at the distal end of the legs 119, the legs 119 contact the floor surface to provide a non-rolling contact between the chair and floor surface. This configuration permits the chair to be moved on casters when it is not being used. This configuration also ensures that the chair remains firmly planted on the legs once a certain amount of downward force is applied to the chair. Those of ordinary skill in the art will appreciate that the caster springs may be configured to compress and expand at different rates depending on the intended use and design of a particular chair. Those of ordinary skill in the art will also appreciate other configurations and types of retractable casters that can be utilized in the presently-disclosed chairs.

Figure 4:
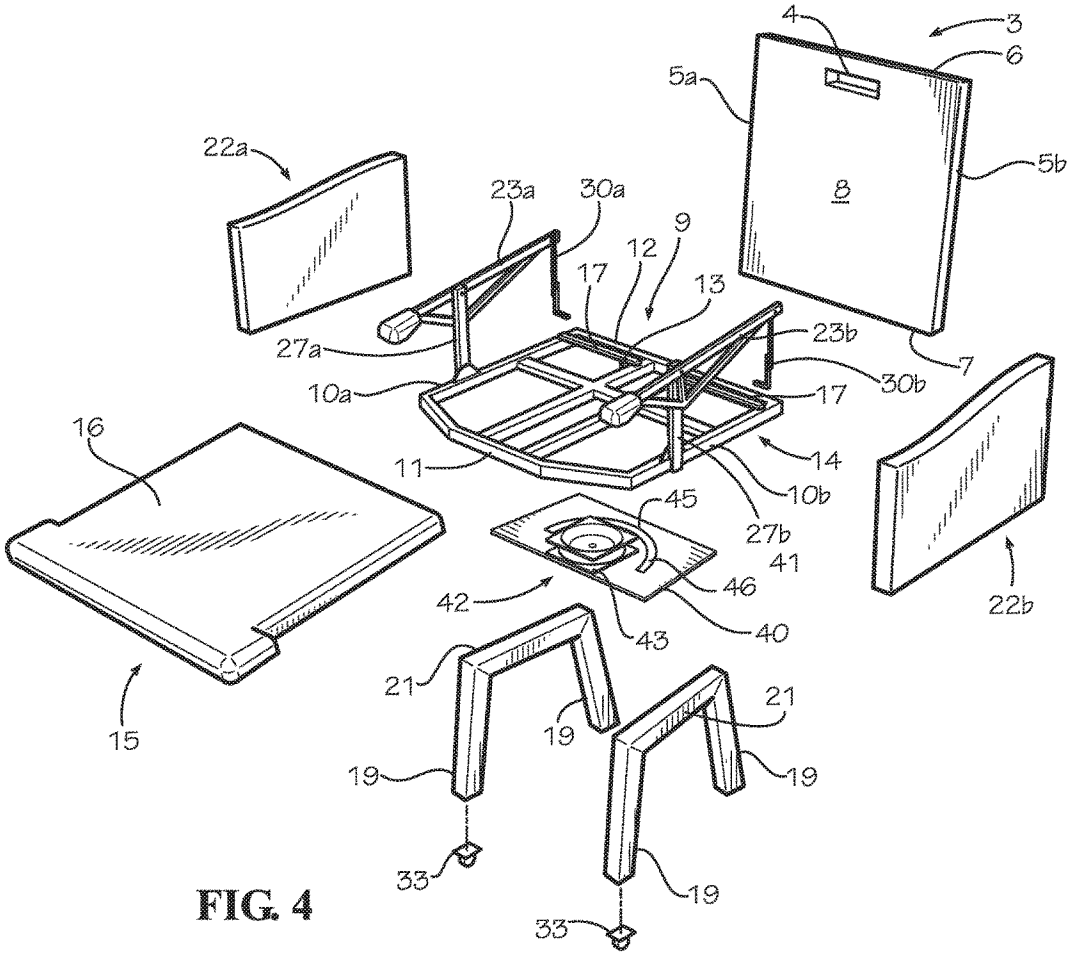
FIG. 4 shows an exploded view of the embodied chair.

Looking now to FIG. 4, an exploded view of the chair 1 is shown. The chair 1 includes a seat frame 9 that includes a frame structure that defines a substantially planar surface. In the embodied chair 1 the seat frame 9 is comprised of metal tubing. The seat frame 9 includes a front edge 11, a rear edge 12, a first lateral edge 11*a*, and a second lateral edge 11*b*. In the embodied chair 1 the rear edge 12 corresponds to a rear end of the generally rectangular seat frame 9. In this regard, the term "edge" generally refers to an area of a structure located along a given side of the structure. For instance, the term "lateral edge" refers to both the physical lateral side of a structure as well as top and bottom surface areas of provided along the lateral side of the structure.

Furthermore, the rear edge corresponds to a rearwardly disposed component that spans between the lateral edges. However, in other embodiments the rear edge does not correspond to the rear end of a seat frame. For instance, in some embodiments the seat frame forms a generally U-shaped structure, and rear edge corresponds to a component that spans between mid-points along the lengths of the lateral edges.

The components that comprise the edges of the seat frame 9 are configured in an arrangement having a substantially rectangular shape. In some embodiments the seat frame is comprised of fewer than four components, and in other embodiments the seat frame is comprised of more than four components. In other embodiments a seat frame can take any shape that is appropriate for the intended use of a chair. The components of a seat frame are not particularly limited, and in some embodiments are comprised of a material selected from wood, composite, polymer, metal, or the like. In yet other embodiments, a seat frame is comprised of a unitary component, such as a continuous metal sheet or the like.

FIG. 4 illustrates that the back frame 3 can be disposed toward the rear edge 12 of the seat frame 9 and extends upwardly relative to a top side 13 of the seat frame 9. In some embodiments the back frame is coupled to a rear edge of a seat frame. The back frame 3 is configured to support an individual in the seated position. Embodiments of back frames can be configured to have any suitable shape or size. Depending on the intended use of a chair 1, the back frame 3 relative to the seat frame 9 can form an angle of about 90 degrees to about 180 degrees, including about 90, 95, 100, 105, 110, 115, 120, 125, 130, 135, 140, 145, 150, 155, 160, 165, 170, 175, or 180 degrees, including and ranges therebetween. In some embodiments the angle of the back frame relative to the seat frame is adjustable.

FIG. 4 also illustrates that the chair 1 includes four legs 19 that extend from a bottom side 14 of the seat frame 9. The legs 19 are substantially perpendicular relative a plane defined by the seat frame 9, and each leg 19 extends from one of the four corners of the seat frame 9. The base 40 is disposed on top of the legs 19, and a swivel 43 is mounted on a top side 41 of the base 40. In other embodiments the base does not include a swivel, and in yet other embodiments the legs are coupled directly to the seat frame.

Figure 5:
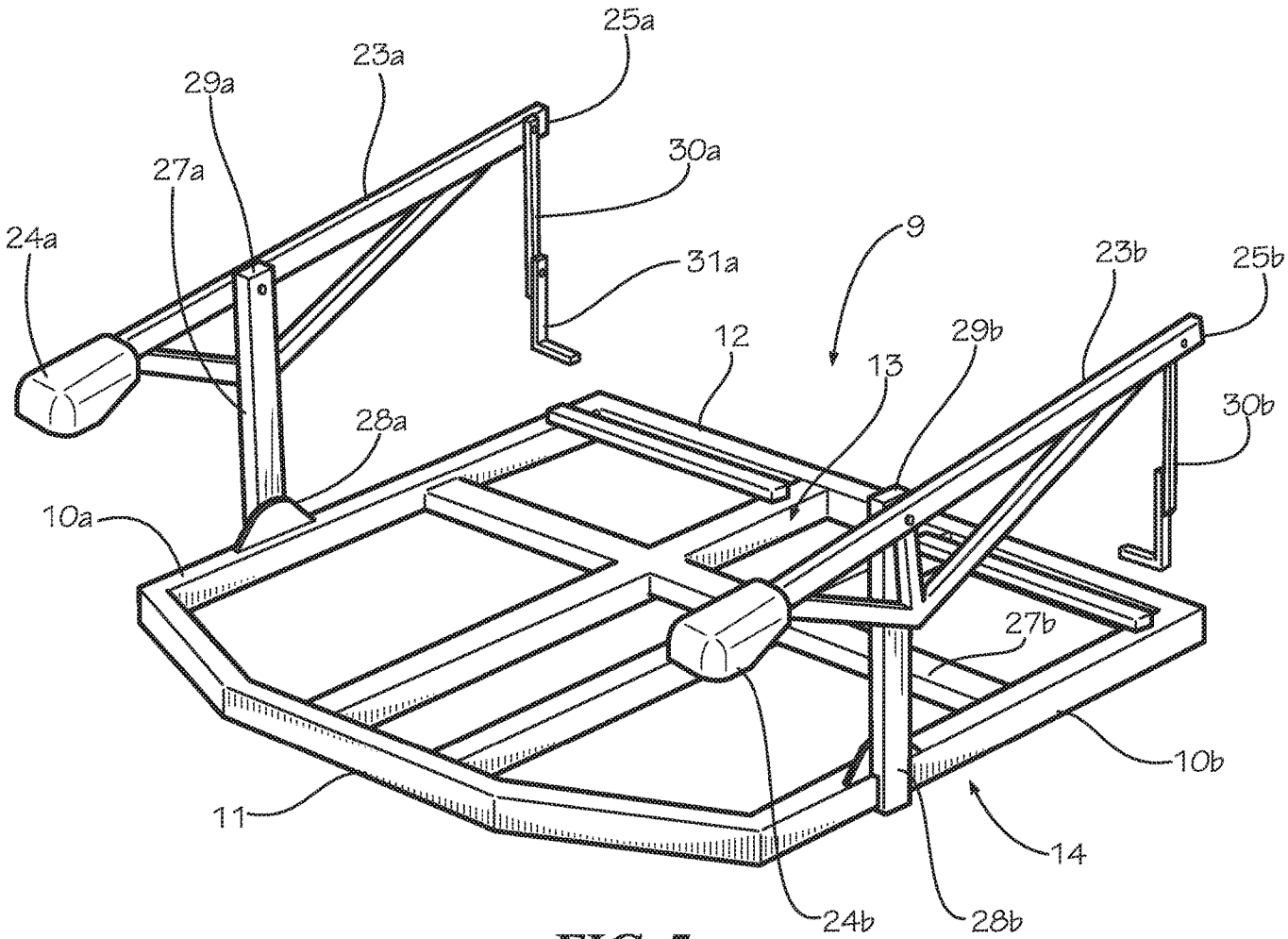
FIG. 5 shows a view of a seat frame and arms of the embodied chair.

FIG. 5 shows an enlarged view of the seat frame 9 and arms 23*a*, 23*b* of the chair 1. A first arm support 27*a* is provided on the first lateral edge 10*a* of the seat frame 9. A proximate (bottom) end 28*a* of the first arm supports 27*a* is coupled to the first lateral edge 10*a* of the seat frame 9. In some embodiments the arm support is coupled to a side or a top of the lateral edges of the seat frame. In other embodiments the arm support is coupled directly to a top side of the seat frame. In yet other embodiments the arm support is coupled to the seat frame in any manner that permits the seat base to move between a depressed position and an extended position with respect to the seat frame.

The distal (top) end 29*a*, of the first arm support 27*a* extends upwardly relative to a top side 13 of the seat frame 9. A first arm 23*a* is provided that has a length and includes a front end 24*a* and a rear end 25*a*. The first arm 23*a* is pivotally coupled to first arm support 27*a* so that the first arm 23*a* can move about its connection point with the first arm support 27*a*. Accordingly, the front end 24*a* and the rear end 25*a* of the first arm 23*a* move in opposite vertical directions as the first arm 23*a* is pivoted about its connection point with the first arm support 27*a*.

Any of the pivoting connections or couplings described herein can be achieved by any means known in the art. For instance, a first component may be bolted to a second component so that it can pivot about an axis that is defined by the bolt. In other instances a pivoting coupling can be achieved by permitting movement of two component as they move in relation to one another. For instance, in embodiments wherein a seat base rests on a top surface of an arm connector without being fixedly fastened thereto, the seat base can pivot with respect to the arm connector as they move in relation to one another. Furthermore, in some embodiments pivoting couplings can include two components that are fixedly fastened to one another, wherein at least one of the components is flexible so that the components may be moved respect to each other.

The first arm 23*a* has a shape that is substantially straight between the front end 24*a* and the rear end 25*a*. In other embodiments the first arm includes a shape that is curved, and in certain embodiments the first arm includes a shape that is curved upwardly so that the front end, the rear end, or the front end and the rear end are disposed higher than a middle point located along a length of the first arm.

The chair 1 further includes a first arm connector 30*a*. One end of the first arm connector 30*a* is coupled to the first arm 23*a* at the rear end 25*a* of the first arm 23*a*. In other embodiments the arm connector is coupled to any point located between the rear end of an arm and a point where the arm is coupled to an arm support. Thus, an arm connector is generally disposed towards a rear end of an arm relative to an arm support.

Another end of the first arm connector 30*a* opposite the end that is coupled to the first arm 23*a* is coupled to the seat base 15. In this respect, the embodied first arm connector 30*a* includes an L-shaped bracket 31*a*, and the seat base 13 is coupled to the top of the first arm connector bracket 31*a*. When the first arm connector 30*a* is moved upwardly, the first arm connector bracket 31*a* can lift the seat base 15 relative to the seat frame 9 from a depressed position to an extended position. In some embodiments the bracket 31*a* is fixably coupled to the seat base 9 with, for example, an adhesive, bolt, screw, or the like.

The first arm connector 30*a* is disposed towards the rear edge 11 with respect to the first arm support 27*a*. Therefore, the first arm connector 30*a* is coupled to the first arm 23*a* at a location disposed toward a rear end 25*a* of the first arm 23*a* with respect to where the first arm support 27*a* is coupled to the first arm 23*a*. Likewise, the first arm connector 30*a* is coupled to the first lateral edge 10*a* at a location disposed toward the rear edge 11 of the seat frame 9 with respect to where the first arm support 27*a* is coupled to the first lateral edge 10*a*. The embodied chair 1 includes pivoting connections between the first arm connector 30*a* and the first arm 23*a* as well as between the first arm connector 30*a* and the seat base 15.

In other embodiments, the first arm connector does not include an L-shaped bracket, and the first arm connector can be coupled to the seat base directly or indirectly through another component. In this regard, the term "arm connector" as used herein refers to any component that couples the arm to the seat base in a manner that permits movement of the arm to translate into movement of the seat base. Thus, the term arm connector is used herein to refer to connectors that include one or more components and that couple the arm to the seat base. In some embodiments an arm connector may or may not comprise a bracket for coupling to a seat base.

As described herein, the chair 1 can further comprise a second arm 23*b*, a second arm support 27*b*, and a second arm connector 30*b* disposed on the second lateral edge 5*b* of the seat frame 9. In the embodied chair 1, the second arm 23*b*, the second arm support 27*b*, and the second arm connector 30*b* are configured to mirror the first arm 23*a*, the first arm support 27*a*, and the first arm connector 30*a*, respectively. Accordingly, in some embodiments all the statements made herein with respect to a first component are applicable to the corresponding second component.

On other embodiments a first component will differ from a corresponding second component. For instance, in some embodiments only one of a first arm and a second arm are configured to pivot and move a seat base between a depressed and an extended position, whereas the other arm is stationary and does not influence the movement of the seat base. In other embodiments, corresponding first and second components are not symmetrical. Possible differences between corresponding first and second components in other embodiments will be appreciated by those of ordinary skill upon reviewing this document.

The arms can be modified or adjusted depending on the intended use or design of a chair. In some embodiments the front end of an arm defines a handle having an aesthetically pleasing design and/or being configured to be comfortable for placement of an individual's hands. In some embodiments the arms can be comprised of two or more separate components that together function as an arm. For instance, in FIG. 5 the arms 23 are comprised of elongated linear components that define lengths extending between a front end 24 and a rear end 25 of the arms 23. Each of the arms 23 include a shorter component that is perpendicular to and extends downwardly from the elongated linear component, and further include two supporting components that each extend from the distal end of the shorter component to one of front end 24 or rear end 25 of the arm. Each set of these four distinct components are coupled together to form each arm 23 of the chair 1.

Figure 6:
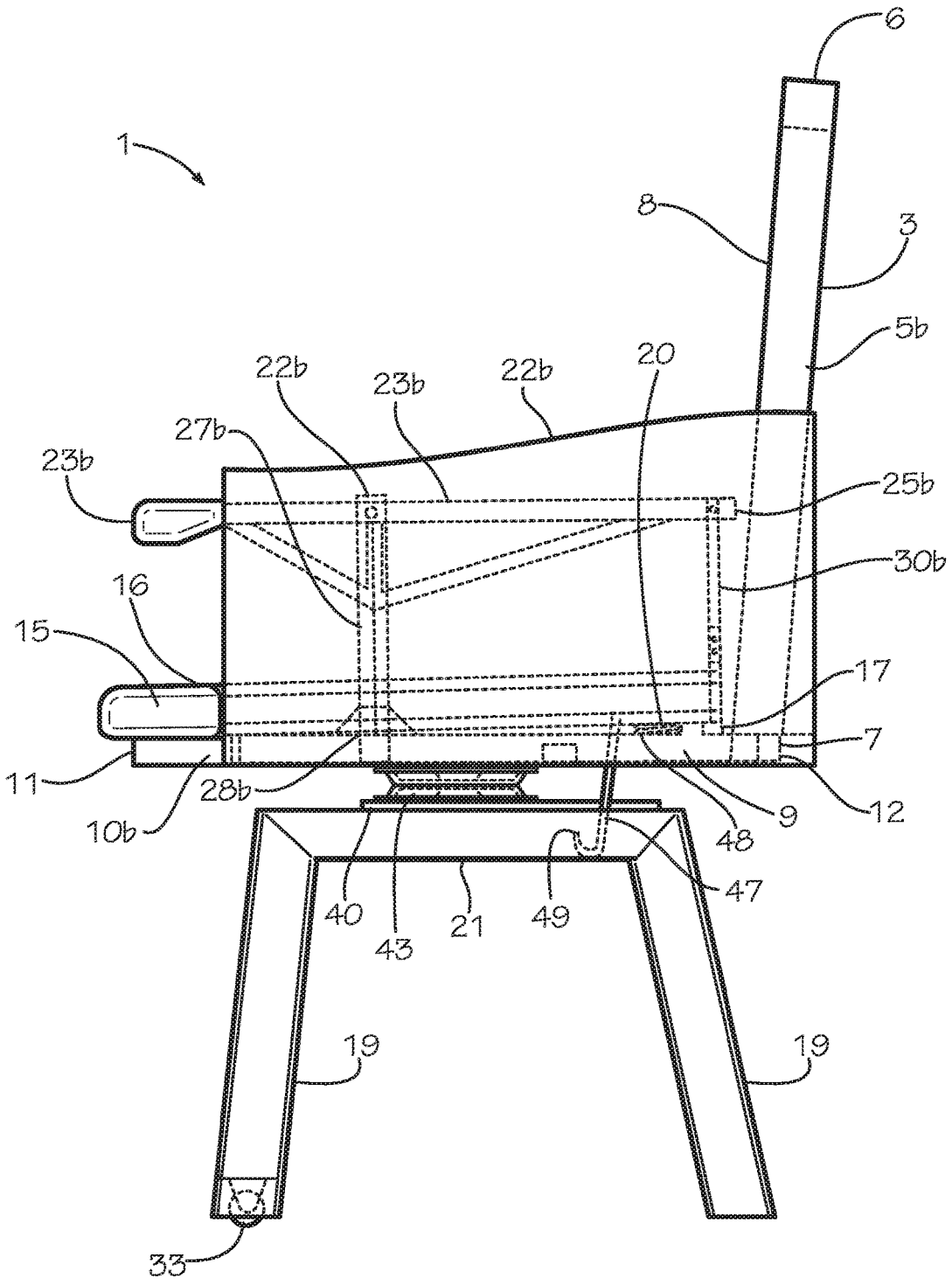
FIG. 6 shows a cross-sectional view of the embodied chair in the depressed position.
Figure 7:
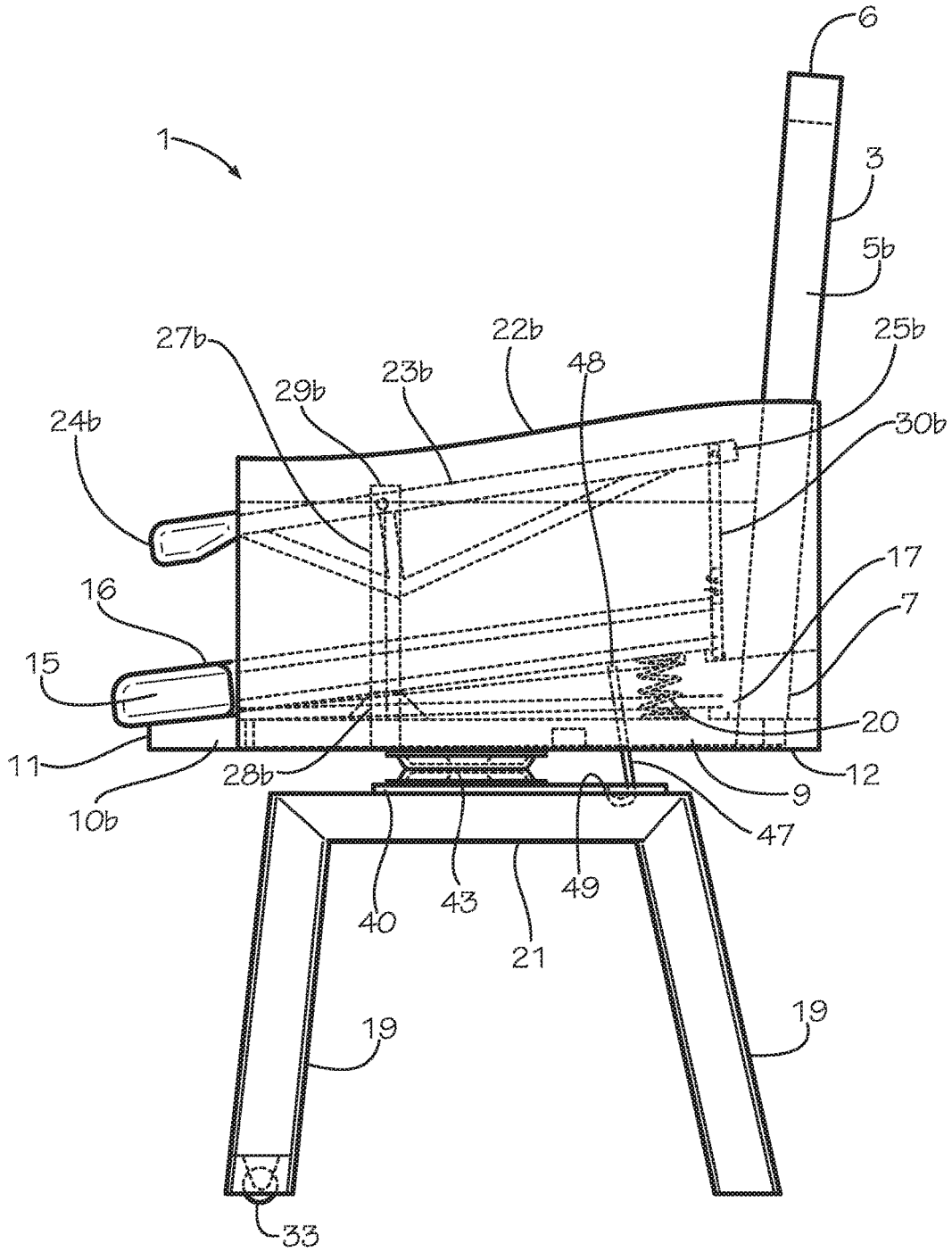
FIG. 7 shows a cross-sectional view of the embodied chair in the extended position.

FIGS. 6 and 7 show side cross-sectional views of the chair 1 in, respectively, the depressed position and the extended position. The chair 1 in the depressed position represents a configuration when a force is applied to the top side of the seat base 15. The depressed position can therefore represents a position of the seat base 15 when an individual is seated on the chair 1. In the depressed position the seat base 15 and the seat frame 9 are both horizontal and substantially parallel to one another. That is, a plane defined by the seat base 15 is substantially parallel (e.g., within about 15 degrees of each other) to a plane defined by the seat frame 9. In other embodiments the seat base and the seat frame in the depressed position are substantially parallel but are not be horizontal. For instance, it may be desirable to have a chair that has a seat base that is tilted forward or backwards in the depressed position so that the chair has an inclined or declined seated position.

The chair 1 in the extended position represents a configuration when no force or a force insufficient for depression is applied to the top side of the seat base 15. The extended position can therefore represents a position of the seat base 15 when an individual is not seated on the chair 1. In the extended position the seat base 15 is angled relative to the seat frame 9, the angle being generally defined by the tilt of the seat base 15 relative to the seat frame 9. In some embodiments the angle of the seat base relative to the seat frame in the extended position is about 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, or 90 degrees, including any ranges and values therebetween. In some embodiments the angle of the seat base relative to the seat frame in the extended position is about 5 to about 90 degrees.

In this regard, the chair 1 is provided with one or more hinges (not shown) along a front edge 11 of the seat frame 9. A front side of the seat base 15 is coupled to the hinges that are provided along the front edge 11 of the seat frame 9. In this manner, the seat base 15 is pivotally coupled to the front edge 11 of the seat frame 9. The hinges permit the seat base 15 to tilt with respect to the seat frame 9 between the depressed position and the extended position. Other embodiments comprise other configurations for achieving such movement of a seat base relative to a seat frame. For instance, in some embodiments the hinges are substituted for other pivoting or flexible components that permit the seat base to pivot with respect to the seat frame. In other embodiments hinges or other pivoting or flexible components are provided on other portions of the seat frame depending on the arrangement of the seat base relative to the seat frame.

The chair 1 also includes a seat stop 17 that is disposed on the top side 13 of the seat frame 9. The seat stop 17 includes one or more objects that, when in the depressed position, stop movement of the seat base 15 relative to the seat frame 9. In the embodied seat frame 9, the seat stop 17 includes two elongated tubes that are disposed on the top side 13 of the seat frame 9 and extend upwardly so that they first contact the seat base 15 when it moves from an raised level in the extended position to a lowered level in the depressed position. The material and configuration of the seat top is not particularly limited. In some embodiments one or more components comprise a seat stop that determine the position of the seat base in the depressed position. The seat stops may be arranged at suitable any location and in any suitable pattern on the top side of the seat frame. Alternatively or additionally, seat stops that determine the position of a seat base in the depressed position may be provided on an arm support or another portion of a chair. In some embodiments the seat stop is integral with a seat frame. The seat stops may be made of any suitable material, including metal, wood, felt, rubber, plastic, or the like.

A pair of springs 20 are provided on the top side 13 of the seat frame 9. By virtue of being mounted between the seat frame 9 and the seat base 15, the springs 20 exert a force against the bottom side of the seat base 15. Thus, the springs 20 can assist movement of the seat base 15 from a depressed position to an extended position. In some embodiments the springs can independently move a seat base from a depressed position to an extended position, and in other embodiments the springs in conjunction with force applied by an individual can move the seat base form a depressed position to an extended position. The springs 20 can also reduce the rate at which the seat base 9 moves from an extended position to a depressed position. This can assist an individual in achieved controlled and gradual movement of the seat base into the depressed position. Embodiments of the present chairs can comprise any number of such springs or other compression mechanisms.

Figure 8:
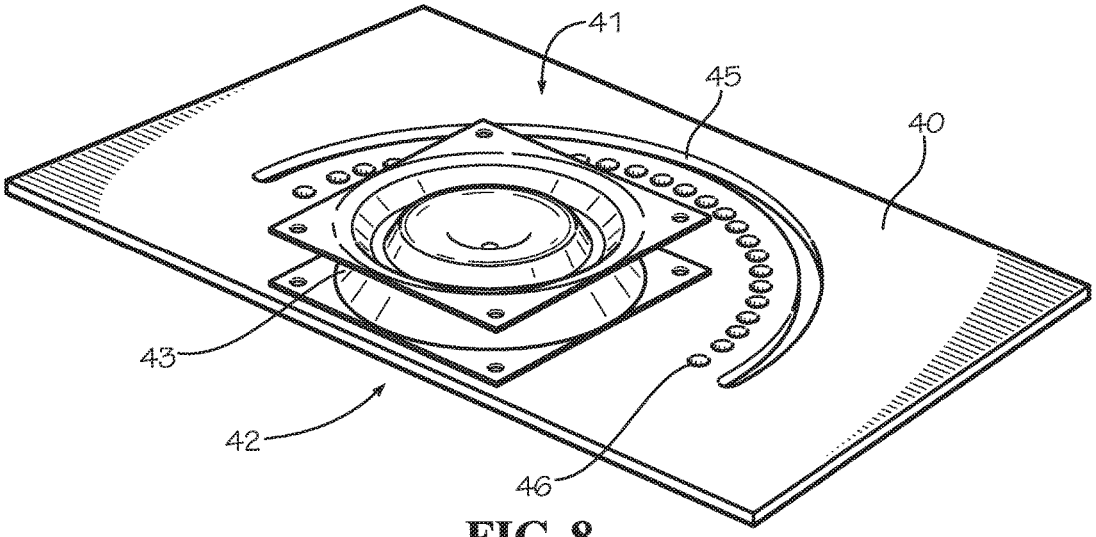
FIG. 8 shows a view of a base and swivel of the embodied chair.

The present chair 1 further includes a mechanism for permitting the chair 1 to rotate about the swivel 43 only when the chair is in the depressed position. As shown in FIGS. 4 and 8, the base 40 includes a slot 45 that extends through the base 40 and has a shape of an arc. The base 40 also includes a plurality of holes 46 that each extend through the base 40 and are arranged in the shape of an arc that is substantially parallel to the slot 45. The chair further includes a hook 47 that has an elongated base end 48 and a tip end 49 disposed at the end of a U-shaped portion of the hook 47. The base end 48 of the hook 47 is coupled to and extends downwardly from the bottom side 14 of the seat base 15. The hook 47 is received by and passes through the slot 45.

The base end 48 of the hook 47 has a length such that, when the seat base 15 is in the depressed position, the tip end 49 of the hook 47 is disengaged and the hook 47 can move freely along a length of the slot 45. In the depressed position, the seat base 15 can rotate (swivel) as the hook 47 moves within the slot 45. When the chair 1 is in the extended position, the hook 47 is configured such that the tip end 49 of the hook 47 can engage one of the plurality of holes 46 provided on the base 40. Namely, as the seat base 15 moves to the extended position, the hook 47 moves upwardly so that the tip end 49 of the hook 47 passes through one of the holes 46 in the base 40. Engagement of the tip end 49 of the hook 47 in one of the holes 46 can block the chair 1 from rotating when in the extended position.

The slot 45 and/or plurality of holes 46 can define arcs having any desired measure, and the measure can correspond to the amount of rotation permitted by the chair 1. In some embodiments the slot and/or plurality of holes define arcs having a measure of about 10 degrees to about 350 degrees, a measure of about 30 degrees to about 300 degrees, a measure of about 45 degrees to about 270 degrees, a measure of about 60 degrees to about 270 degrees, or a measure of about 90 degrees to about 180 degrees. In certain embodiments the slot and/or plurality of holes define arcs having a measure selected from about 10, 20, 30, 40, 50, 60, 70, 80, 90, 100, 110, 120, 130, 140, 150, 160, 170, 180, 190, 200, 210, 220, 230, 240, 250, 260, 270, 280, 290, 300, 310, 320, 330, 340, or 350 degrees.

A method for operating the embodied list-assist chair 1 will now be described. When sitting, an individual can apply a downward force on the front ends 24 the arms 23. As shown in FIGS. 6 and 7, this downward force causes the arms 23 to pivot about their connection points with the arm supports 27 so that the rear ends 25 of the arms 23 lift upwardly. In turn, as the rear ends 25 of the arms 23 lift upwardly, the arm connectors 29 cause the rear side of the seat base 13 to also lift upwardly. This configuration, wherein the front ends 24 of the arms 23 are pivoted downward to lift the seat base 15, is referred to herein as the "extended position."

An individual may apply force on the seat base 15 as they lower themselves into the chair 1 to sit. During this time, one may continue to apply a desired amount of downward force on the front ends 24 of the arms 23 in order to counteract the force of their weight on the seat base 15. Furthermore, since the seat base 15 is tilted upwardly in the extended position, the distance an individual must lower themselves before making contact with the chair 1 is decreased relative to a traditional chair. These factors help reduce the strain that is placed on an individual's legs and arms as they attempt to lower themselves into a seated position, and also permits individuals to sit in a more gradual and safe manner.

As an individual continues to lower themselves, the seat base 15 will lower to a point that the seat base 15 contacts the seat stop 17. A position wherein an individual is seated on the chair 1 is referred to herein as the "depressed position." The mass of an individual is in a seated position can hold the arms 23 in a fixed position.

Those of ordinary skill in the art will appreciate that the presently-disclosed lift-assist chair can provide numerous advantages. For those who are disabled, injured, elderly, or the like, the chair can greatly ease the process of sitting and standing. The chair also provides numerous safety benefits. For instance, because one is assisted when sitting and/or standing, abrupt forces or movements can be decreased, which can decrease the risk of having a chair slide out from under a under. Sitting gradually also minimizes any potential risk of imbalance that may be caused by quickly sitting or falling into a chair.

The presently-disclosed chair 1 can also assist an individual who desires to stand from a seated position. As one prepares to stand, they can apply a downward force on the front ends 24 of the arms 23. This downward force on the arms 23 is communicated through the arm connectors 30 to apply an upward force on the seat base 15 and tilt the seat base 15 upwardly from a depressed position to an extended position. As the individual begins to stand, the seat base 13 will continue moving upwardly to assist the individual to stand up from a seated position. In this manner, one can utilize both upper body strength and mass to facilitate standing from the chair 1.

In this regard, the location and arrangement of the seat frame 9, the arm supports 27, the arms 23, the arm connectors 30, and the seat base 15 can be altered depending on the particular configuration of a chair. For instance, the configuration of these elements can be altered to increase or decrease the amount of leverage the arms provide when moving the seat base relative to the seat frame. In some embodiments a proximate end 28*a* or 28*b* of an arm support 27*a* or 27*b* can be coupled to a lateral edge of a seat frame at any location between a rear edge and a front edge of the seat frame. Similarly, in some embodiments the distal end 29*a* or 29*b* of an arm support 27*a* or 27*b* can be coupled to an arm at any location between a front end and a rear end of the arm 23*a* or 23*b*. Furthermore, in some embodiments an arm connector can be coupled to any point on an arm and on any point of a seat base.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

Figure 10:
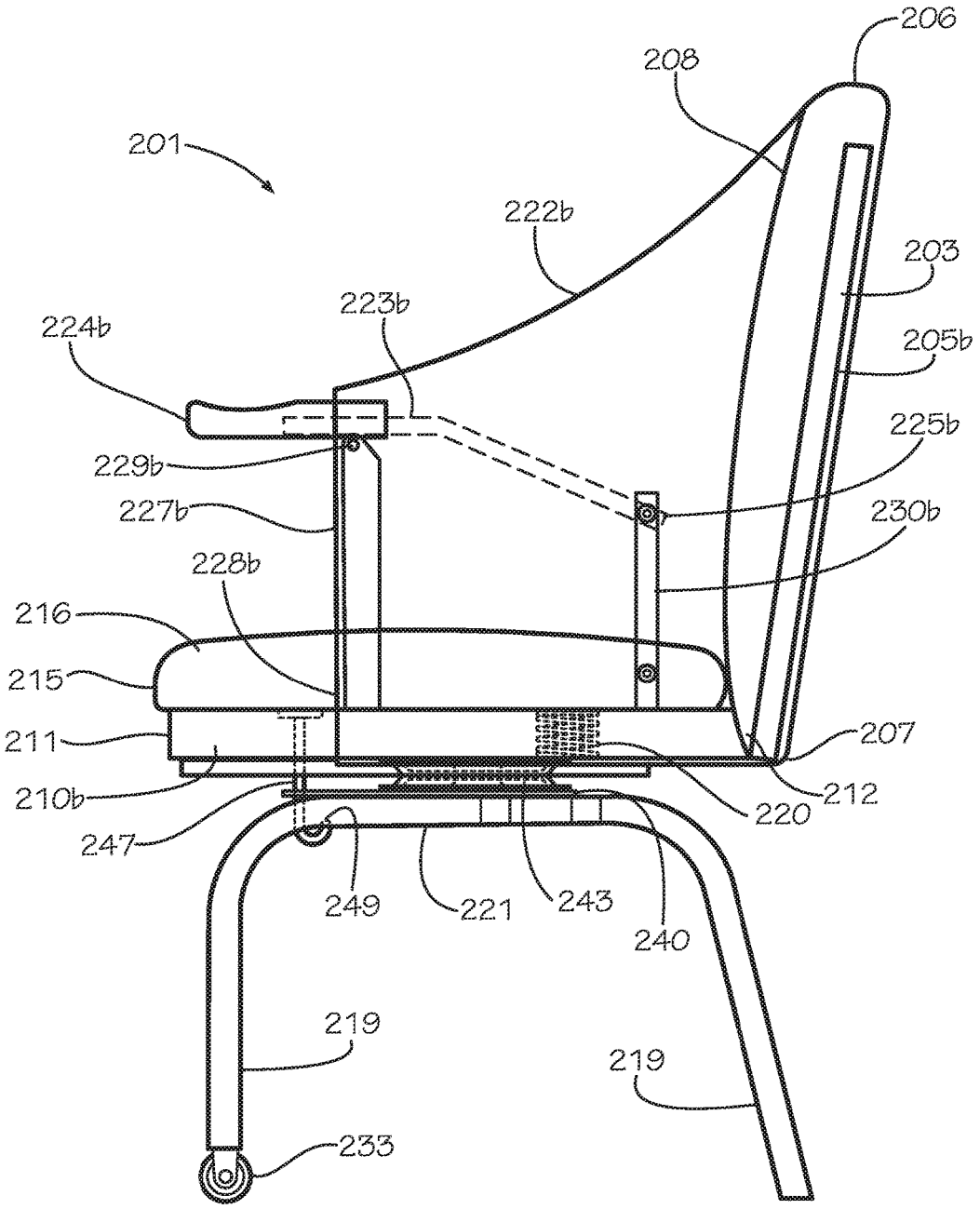
FIG. 10 shows side cross-sectional view of a lift-assist chair in accordance with yet another embodiment of the presently-disclosed subject matter.
Figure 11:
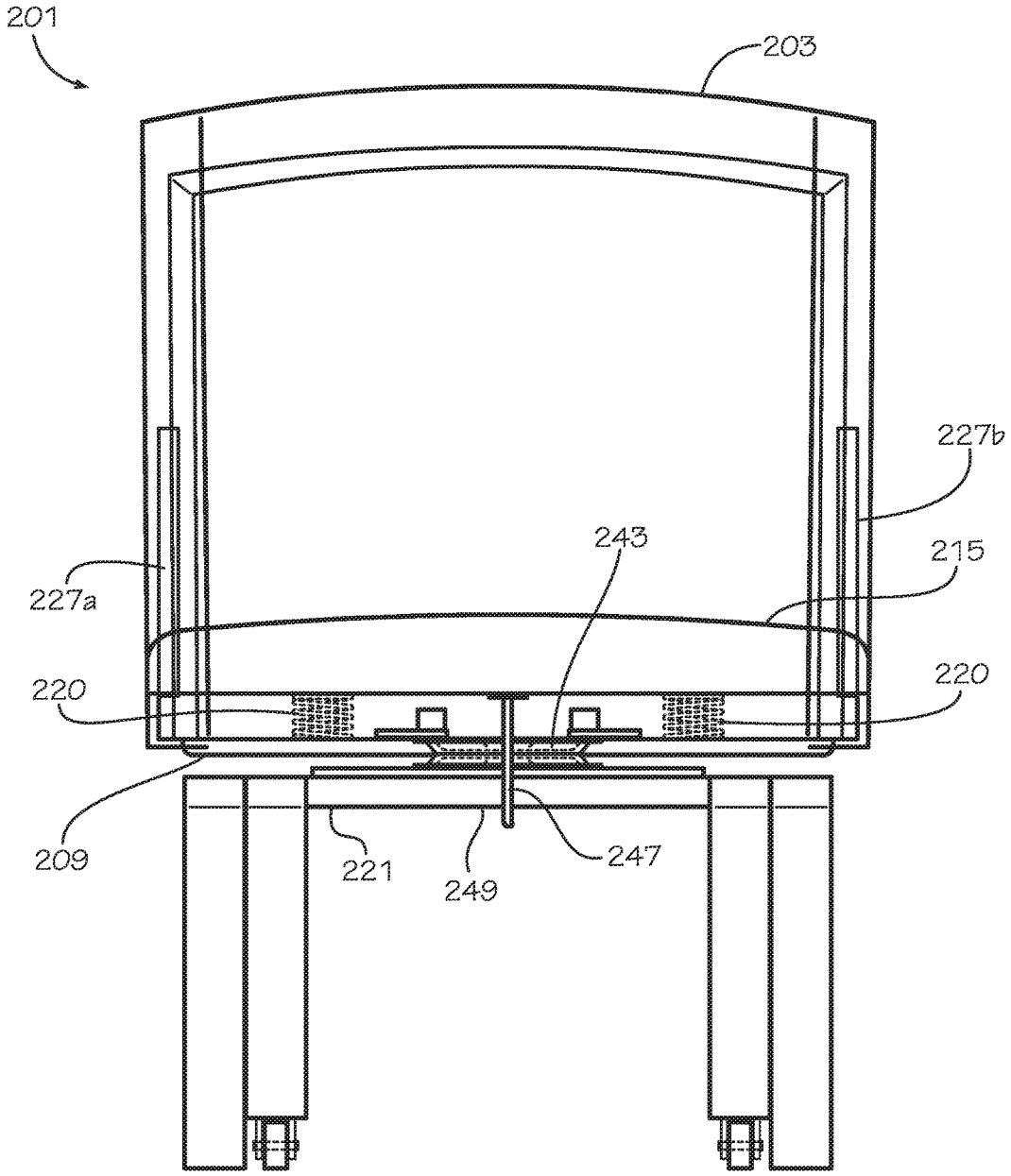
FIG. 11 shows top cross-sectional view of the chair of FIG. 10.

For instance, FIGS. 10 and 11 show a lift-assist chair 201 in accordance with another embodiment of the presently-disclosed subject matter. The chair 201 includes a back frame 203 that supports a back cushion 208, the back frame 203 having two lateral edges 205*a*, 206*b*, a top edge 206, and a bottom edge 207. The chair 201 also includes a seat frame 209 having two lateral edges 210*a*, 210*b*, a front edge 211, a rear edge 212, a top side 213, and a bottom side 214. The chair 201 further comprises a seat base 215 that itself includes a seat cushion 206 provided on a top side 213 of the seat frame 209. The chair is supported by legs 219 that have leg supports 212, and two of the legs have casters 233 provided on distal ends thereof.

The lift and lowering mechanism of the chair 201 is operated at least in part by the arms 223*a*, 223*b*. The arms 223*a*, 223*b* can pivot about arm supports 227*a*, 227*b* that extend from the seat base 209. Pushing the front ends 224*a*, 224*b* of the arms 223*a*, 223*b* downward moves the rear ends 225*a*, 225*b* of the arms 223*a*, 223*b* upward, which causes the arm connectors 230*a*, 230*b* to lift the seat base 215. Each of the arm connectors 230*a*, 230*b* are pivotally coupled to both the arms 223*a*, 223*b* and the seat base 209. This up and down movement is assisted by a pair of springs 220 provided between the seat frame 209 and the seat base 215.

A base 240 is mounted on the leg supports 221, a swivel 243 is mounted on the base 240, and the seat frame 209 is mounted on the swivel 243. A base end 48 of a hook 247 is mounted to a bottom side 214 of the seat base 215, and hook 247 extends downwardly through a slot 245 provided in the base 240. When the chair 201 is in the extended position, a tip end 249 of the hook 247 can one of a plurality of holes 246 provided in the base 40.

The presently-disclosed subject matter can comprise, consist of, or consist essentially of the elements and features of the embodiments described herein, as well as any additional or optional components or limitations described herein or otherwise useful.

The term "component" as used herein refers to a discrete element that alone or in combination with other element forms a part of a chair. For instance, in some embodiments an arm can be comprised of a single component or an arm can be comprised of a plurality of components that are coupled together to form an arm.

As used herein, the term "about," when referring to a value or measurement is meant to encompass variations of in some embodiments ±50%, in some embodiments ±40%, in some embodiments ±30%, in some embodiments ±20%, in some embodiments ±10%, in some embodiments ±5%, in some embodiments ±1%, in some embodiments ±0.5%, and in some embodiments ±0.1% from the specified amount, as such variations are appropriate.

Unless defined otherwise, all technical and scientific terms used herein have the same meaning as commonly understood by one of ordinary skill in the art to which the presently-disclosed subject matter belongs. Certain definitions are set forth to facilitate explanation of the presently-disclosed subject matter.

All references to singular characteristics or limitations of the present disclosure shall include the corresponding plural characteristic(s) or limitation(s) and vice versa, unless otherwise specified or clearly implied to the contrary by the context in which the reference is made.

NUMBERED LIST OF ELEMENTS

Chair—1
Back frame—3
Handle—4
Lateral edge of back frame—5
Top edge of back frame—6
Bottom edge of back frame—7
Back cushion—8
Seat frame—9
Lateral edge of seat frame—10
Front edge of seat frame—11
Rear edge of seat frame—12
Top side of seat frame—13
Bottom side of seat frame—14
Seat base—15
Seat cushion—16
Seat stop—17
Leg—19
Spring—20
Leg support—21
Side panels—22
Arm—23
Arm front end—24
Arm rear end—25
Arm support—27
Proximate end of arm support—28
Distal end of arm support—29

Arm connector—30
Arm connector bracket—31
Caster—33
Caster spring—35
Base—40
Base top side—41
Base bottom side—42
Swivel—43
Slot—45
Holes—46
Hook—47
Base end of hook—48
Tip end of hook—49

What is claimed is:

1. A chair, comprising:

a seat frame having a front edge, a rear edge, a first lateral edge, a second lateral edge, a bottom side, and a top side;

a seat base disposed on the top side of the seat frame that is pivotally coupled to the front edge of the seat frame, the seat base being moveable with respect to the seat frame between a depressed position and an extended position;

a first arm support having a proximate end that is coupled to the first lateral edge of the seat frame and a distal end that extends from the top side of the seat frame;

a first arm having a front end and a rear end, the first arm being pivotally coupled to the first arm support about a point located between the front end and the rear end of the first arm;

a base having a top side and a bottom side, the base being disposed on a bottom side of the seat frame; and a swivel mounted to the top side of the base and coupled to the seat frame.

2. The chair of claim 1, further comprising:

a second arm support having a proximate end that is coupled to the second lateral edge of the seat frame and a distal end that extends from the top side of the seat frame;

a second arm having a front end and a rear end, the second arm being pivotally coupled to the second arm support about a point located between the front end and the rear end of the second arm;

a first arm connector having one end coupled to the first arm and another end coupled to the seat base, the first arm connector being disposed towards the rear end of the first arm relative to the first arm support; and a second arm connector having one end coupled to the second arm and another end coupled to the seat base, the second arm connector being disposed towards the rear end of the second arm relative to the second arm support.

3. The chair of claim 1, further comprising a plurality of legs extending from the bottom side of the seat frame.

4. The chair of claim 3, further comprising casters on distal ends of two of the legs.

5. The chair of claim 4, wherein the casters are partially recessed within the distal ends of the legs.

6. The chair of claim 1, further comprising a back frame coupled to a rear edge of the seat frame and extending from the top side of the seat frame.

7. The chair of claim 1, further comprising a seat stop disposed on the top side of the seat frame, the seat stop being disposed toward the rear edge of the seat frame relative to the first arm support.

8. The chair of claim 1, further comprising a spring disposed on the top side of the seat frame, the spring being configured to exert force on the seat base to move the seat base relative to the seat frame.

9. The chair of claim 1, further comprising:

a slot extending through the base and having a shape of an arc;

a plurality of holes that each extend through the base and are arranged in the shape of an arc that is substantially parallel to the slot; and a hook having a base end and a tip end and that is slideably received through the slot, the base end being coupled to a bottom side of the seat base and the tip end being configured to engage one of the plurality of holes when the seat base is in the extended position.

10. The chair of claim 9, wherein the slot defines an arc having a measure of about 90 degrees to about 270 degrees.

11. The chair of claim 9, further comprising a spring disposed on the top side of the seat frame, the spring being configured to exert force on the seat base to pivot the seat base relative to the seat frame.

12. The chair of claim 1, wherein the seat base in the depressed position is substantially parallel to the seat frame, and wherein the seat base in the extended position is angled by about 5 degrees to about 60 degrees relative to the seat frame.

13. A chair, comprising:

a seat frame having a front edge, a rear edge, two lateral edges, a bottom side, and a top side;

a seat base disposed on the top side of the seat frame that is pivotally coupled to the front edge of the seat frame, the seat base being moveable with respect to the seat frame between a depressed position and an extended position;

a pair of arm supports each extending from one of the lateral edges of the seat frame;

a pair of arms each having a front end and rear end, each of the arms being pivotally coupled to one of the arm supports at a point located between of the front end and the rear end of each of the arms, each of the pair of arms coupled to the seat base;

a base having a top side and a bottom side, the base being disposed on a bottom side of the seat frame;

a swivel mounted to the top side of the base and coupled to the seat frame;

and at least one leg extending from the bottom side of the seat frame.

14. The chair of claim 13, further comprising:

a pair of arm connectors that each couple one of the arms to the seat base.

15. The chair of claim 14, further comprising:

a slot extending through the base and having a shape of an arc;

a plurality of holes that each extend through the base and are arranged in the shape of an arc that is substantially parallel to the slot; and a hook that is slideably received through the slot and having a base end and a tip end, the base end being coupled to a bottom side of the seat base, and the tip end being configured to engage one of the plurality of holes when the seat base is in the extended position.

16. The chair of claim 13, further comprising a spring that exerts a force between the seat frame and seat base.

17. A chair, comprising:

a seat frame;

a seat base disposed on the top side of the seat frame that can be moved with respect to the seat frame between a depressed position and an extended position;

an arm support that extends upwardly from the seat frame;

an arm that is pivotally coupled to the arm support and coupled to the seat base;

a base having a top side and a bottom side, the base being disposed on a bottom side of the seat frame; and a swivel mounted to the top side of the base and coupled to the seat frame.

18. The chair of claim 17, further comprising:

a slot extending through the base and having a shape of an arc;

a plurality of holes that each extend through the base and are arranged in the shape of an arc that is substantially parallel to the slot; and a hook that is slideably received through the slot and having a base end and a tip end, the base end being coupled to a bottom side of the seat base, and the tip end being configured to engage one of the plurality of holes when the seat base is in the extended position.

19. The chair of claim 17, further comprising a spring disposed between the seat frame and seat base configured to move the seat base between the depressed position and the extended position.

* * * * *